US010783775B2

(12) United States Patent
Durekovic et al.

(10) Patent No.: US 10,783,775 B2
(45) **Date of Patent: *Sep. 22, 2020**

(54) METHOD AND SYSTEM FOR USING INTERSECTING ELECTRONIC HORIZONS

(71) Applicant: HERE Global B.V., Eindhoven (NL)

(72) Inventors: Sinisa Durekovic, Idstein (DE); Nicholas E. Smith, Worcestershire (GB)

(73) Assignee: HERE Global B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/232,690

(22) Filed: Dec. 26, 2018

(65) Prior Publication Data

US 2019/0172343 A1 Jun. 6, 2019

Related U.S. Application Data

(63) Continuation of application No. 15/710,333, filed on Sep. 20, 2017, now Pat. No. 10,198,940, which is a (Continued)

(51) Int. Cl.
*G08G 1/01* (2006.01)
*G08G 1/16* (2006.01)

(Continued)

(52) U.S. Cl.
CPC ..... *G08G 1/0112* (2013.01); *G08G 1/161* (2013.01); *G08G 1/164* (2013.01); *G08G 1/22* (2013.01); *G08G 1/095* (2013.01)

(58) Field of Classification Search
None
See application file for complete search history.

(56) References Cited

U.S. PATENT DOCUMENTS 3,941,201 A 3/1976 Hermann et al.
6,393,362 B1 5/2002 Burns (Continued)

FOREIGN PATENT DOCUMENTS

WO WO2006045826 5/2006

OTHER PUBLICATIONS

GOMI, Digital Map Data from Vehicle Probes, Aug. 7, 2001, Yogmi LLC.

(Continued)

*Primary Examiner* — Fekadeselassie Girma
(74) *Attorney, Agent, or Firm* — Lempia Summerfield Katz LLC

(57) ABSTRACT

A method and system for using data associated with a first vehicle and a given road segment defined for a road network and using data associated with a second vehicle and the given road segment to determine a multi-vehicle probability value that indicates a probability that the first vehicle and the second vehicle will arrive at a common position of the given road segment simultaneously. The multi-vehicle probability value can be compared to a threshold probability value to determine whether the first vehicle and/or the second vehicle should take a responsive measure to avoid those vehicles arriving at the common position of the given road segment simultaneously. The data associated the first vehicle and the data associated with the second vehicle can each include a respective electronic horizon for that vehicle, and time parameters and probability values associated with those vehicles being on the given road segment.

20 Claims, 5 Drawing Sheets

Related U.S. Application Data continuation of application No. 15/097,457, filed on Apr. 13, 2016, now Pat. No. 9,799,216, which is a continuation of application No. 14/251,031, filed on Apr. 11, 2014, now Pat. No. 9,330,564, which is a continuation of application No. 12/900,780, filed on Oct. 8, 2010, now Pat. No. 8,717,192.

(51) Int. Cl.
*G08G 1/00* (2006.01)
*G08G 1/095* (2006.01)

(56) References Cited

U.S. PATENT DOCUMENTS 6,405,128 B1 6/2002 Bechtolsheim et al.
6,700,504 B1 3/2004 Aslandogan et al.
6,735,515 B2 5/2004 Bechtolsheim et al.
6,853,906 B1 2/2005 Michi et al.
7,038,577 B2 * 5/2006 Pawlicki ..... B60W 30/12 340/435
7,057,532 B2 6/2006 Shafir et al.
8,717,192 B2 * 5/2014 Durekovic ..... G08G 1/161 340/903
8,965,685 B1 2/2015 Denaro
9,330,564 B2 * 5/2016 Durekovic ..... G08G 1/161
9,415,776 B2 * 8/2016 Schwindt ..... B60W 30/12
9,545,922 B1 * 1/2017 Sim ..... B60W 30/12
9,799,216 B2 * 10/2017 Durekovic ..... G08G 1/161
9,946,940 B2 * 4/2018 Gupta ..... G06K 9/00798
10,198,940 B2 * 2/2019 Durekovic ..... G08G 1/161
10,255,509 B2 * 4/2019 Gupta ..... G06K 9/00798
10,315,651 B2 * 6/2019 Fiaschetti ..... B60W 30/12
10,360,460 B2 * 7/2019 Jiang ..... G06K 9/00798
2004/0022416 A1 2/2004 Lemelson et al.
2005/0015203 A1 * 1/2005 Nishira ..... G08G 1/167 701/301
2005/0107931 A1 * 5/2005 Shimakage ..... G08G 1/167 701/41
2005/0125125 A1 * 6/2005 Matsumoto ..... B62D 15/029 701/41
2005/0273234 A1 * 12/2005 Rattapon ..... B62D 1/28 701/41
2006/0030987 A1 * 2/2006 Akita ..... B62D 15/025 701/41
2006/0047388 A1 * 3/2006 Oka ..... B60R 21/013 701/41
2006/0097858 A1 5/2006 Kumabe et al.
2006/0287807 A1 12/2006 Teffer
2007/0100551 A1 * 5/2007 Ishikura ..... B60T 8/17557 701/301
2007/0135990 A1 6/2007 Seymour et al.
2007/0225914 A1 * 9/2007 Kawazoe ..... B60W 30/12 701/301
2007/0233343 A1 * 10/2007 Saito ..... B62D 15/025 701/41
2007/0233386 A1 * 10/2007 Saito ..... G08G 1/167 701/300
2007/0276600 A1 * 11/2007 King ..... G08G 1/166 701/301
2008/0065328 A1 3/2008 Eidehall et al.
2008/0303696 A1 12/2008 Aso et al.
2009/0024357 A1 * 1/2009 Aso ..... G08G 1/161 702/181
2009/0189780 A1 7/2009 Machida
2010/0057361 A1 3/2010 Caveney et al.
2010/0063728 A1 * 3/2010 Jung ..... G09B 29/10 701/533
2010/0182139 A1 * 7/2010 Chen ..... B60W 30/12 340/435
2011/0087433 A1 4/2011 Yester
2014/0005906 A1 * 1/2014 Pandita ..... B60W 40/04 701/96
2018/0025631 A1 * 1/2018 Durekovic ..... G08G 1/164 701/117
2019/0172343 A1 * 6/2019 Durekovic ..... G08G 1/161

OTHER PUBLICATIONS

Lamm, SwRI: Intelligent Vehicle Systems and Cooperative Systems, printed Aug. 24, 2010, www.swri.org.
Mathia et al., Cooperative Control of UAV Platoons—A Prototype, Jun. 13-15, 2007, Euro UAV 2007 Conference and Exhibition, Paris, France.
Simon et al., Collaborative Driving System Using Teamwork for Platoon Formations, printed from www.citeulike.org on Aug. 24, 2010, pp. 133-151, Applications of Agent Technology in Traffic and Transportation (2005).

* cited by examiner

METHOD AND SYSTEM FOR USING INTERSECTING ELECTRONIC HORIZONS

This application is a continuation under 37 C.F.R. § 1.53(b) and 35 U.S.C. § 120 of U.S. patent application Ser. No. 15/710,333 filed Sep. 20, 2017, which is a continuation of U.S. patent application Ser. No. 15/097,457 (now U.S. Pat. No. 9,799,216) filed Apr. 13, 2016, which is a continuation of U.S. patent application Ser. No. 14/251,031 (now U.S. Pat. No. 9,330,564) filed Apr. 11, 2014, which is a continuation of U.S. patent application Ser. No. 12/900,780 (now U.S. Pat. No. 8,717,192) filed Oct. 8, 2010, each of which are incorporated herein by reference in their entirety.

FIELD

The present invention relates generally to an electronic horizon, and more particularly, relates to intersecting electronic horizons.

BACKGROUND

Vehicles, such as automobiles, ambulances, military trucks, and semi-tractors, are designed to operate on networks of roads with other vehicles. An increasing number of vehicles are being built with Advanced Driver Assistance Systems (ADAS). The ADAS in each of those vehicles can use digital map data to provide that vehicle with information about the road network on which the vehicle travels.

U.S. Pat. No. 6,405,128 describes methods and systems for providing an electronic horizon in an ADAS architecture. The electronic horizon may identify multiple paths leading from a vehicle's current position. Each path within the electronic horizon may include one or more intersections through which a driver may maneuver the vehicle. A respective probability may be assigned to each path identified for the electronic horizon. Those probabilities may be based on the most-likely maneuvers a driver may take at each intersection identified for the electronic horizon. Determining the most-likely maneuver and lower-probability maneuvers that a driver may take at each intersection of the electronic horizon may be based on a predetermined ranking of all possible maneuvers that may be made at that intersection, taking into account information regarding the road network, such as turn angles, road function classes, traffic signals, and speed limits or dynamic information, such as direction indicators and driving history.

Although U.S. Pat. No. 6,405,128 describes many useful features, there exists room for further improvements. The description that follows provides example embodiments of such improvements.

SUMMARY

In one respect, an example embodiment may take the form of a method comprising: (i) receiving a first set of vehicle data, wherein the first set of vehicle data includes data that is associated with a first vehicle and a given road segment defined for a road network on which the first vehicle can travel, (ii) receiving a second set of vehicle data, wherein the second set of vehicle data includes data that is associated with a second vehicle and the given road segment defined for the road network, wherein the second vehicle can travel on the road network, (iii) using at least a portion of the first set of vehicle data and at least a portion of the second set of vehicle data to determine a first multi-vehicle probability value that indicates a probability that the first vehicle and the second vehicle will arrive at a common position of the given road segment simultaneously, and (iv) taking a responsive measure if the first multi-vehicle probability value exceeds a threshold probability value.

In another respect, an example embodiment may be arranged as a computer-readable data storage device comprising: (i) a first set of vehicle data, wherein the first set of vehicle data includes data that is associated with a first vehicle and a given road segment defined for a road network on which the first vehicle can travel, (ii) a second set of vehicle data, wherein the second set of vehicle data includes data that is associated with a second vehicle and the given road segment defined for the road network, wherein the second vehicle can travel on the road network, (iii) computer-readable program instructions executable by a processor to use at least a portion of the first set of vehicle data and at least a portion of the second set of vehicle data to determine one or more multi-vehicle probabilities, wherein each multi-vehicle probability value indicates a probability of whether the first vehicle and the second vehicle will arrive at a common position of the given road segment simultaneously, and (iv) computer-readable program instructions executable by the processor to determine whether any of the multi-vehicle probabilities exceeds a threshold probability and to trigger a responsive measure to be carried out if any of the multi-vehicle probabilities exceeds the threshold probability.

In yet another respect, an example embodiment may take the form of a method comprising (i) receiving a first set of vehicle data, wherein the first set of vehicle data includes data that is associated with at least a first vehicle traveling in a platoon of vehicles on a road network, (ii) receiving a second set of vehicle data, wherein the second set of vehicle data includes data that is associated with a second vehicle destined to enter the platoon of vehicles, and (iii) using at least a portion of the first set of vehicle data and at least a portion of the second set of vehicle data to determine an adjustment for at least one vehicle to make in order for the second vehicle to enter the platoon of vehicles.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings, in which.

DETAILED DESCRIPTION

I. Introduction

Figure 1:
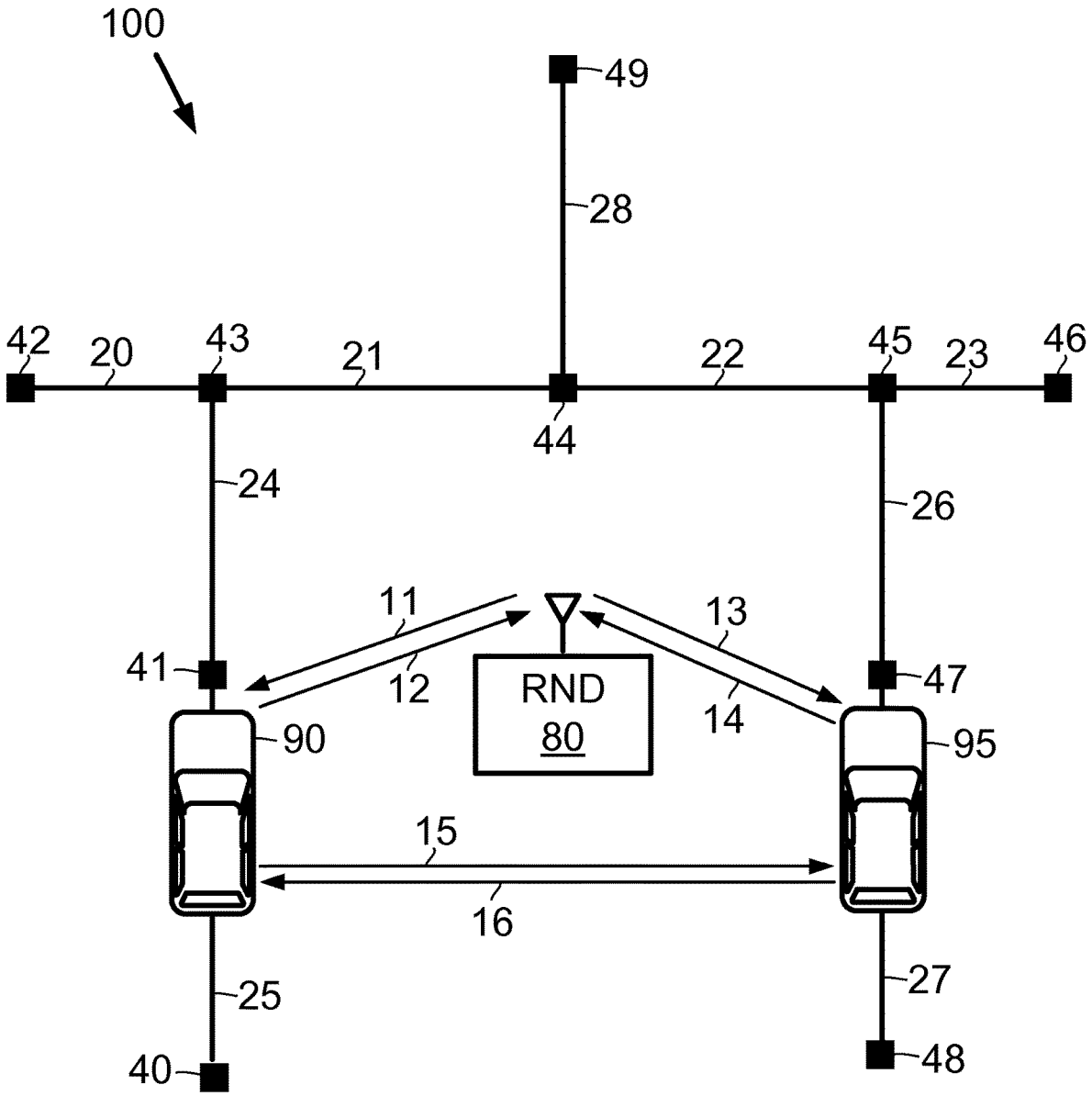
FIG. 1 illustrates an example road network.

An advanced driver assistance system (ADAS) operating within a vehicle may use an electronic horizon to continuously provide the vehicle with updated data about paths along roads onto which the vehicle can travel from the vehicle's current position. The electronic horizon refers to a collection of roads and intersections leading out from the vehicle's current position, and the potential driving paths of the vehicle from that current position. Each vehicle of a plurality of vehicles can generate a respective electronic horizon and provide that electronic horizon to another vehicle or device. Each of the electronic horizons can then be stored in a data storage device as a respective set of vehicle data. Additional details regarding electronic horizons are described in U.S. Pat. Nos. 6,450,128 and 6,735,515. The entire disclosures of U.S. Pat. Nos. 6,450,128 and 6,735,515 are incorporated by reference herein.

This description provides details of various example embodiments. In one respect, the example embodiments pertain to methods and systems for using intersecting electronic horizons for a plurality of vehicles. The example embodiments include embodiments in which electronic horizons (i.e., sets of vehicle data) or at least portions of the electronic horizons from multiple vehicles are combined. If the electronic horizons include time parameters, the electronic horizons may additionally be referred to as "Time Domain Electronic Horizons." The combination of electronic horizons or vehicle data may be referred to as an "intersecting electronic horizon," or additionally as an "intersecting time domain electronic horizon" if the combined electronic horizons include time parameters.

In order to combine electronic horizons, vehicle-to-vehicle communications may be established between vehicles to distribute electronic horizons between vehicles. A road network device may notify a given vehicle operating within a given area (e.g., a 1 Km radius surrounding the road network device) of the other vehicles within that given area that have the capability to provide an electronic horizon to the given vehicle. Additionally or alternatively, the road network device may operate as intermediary device that communicates electronic horizon data from one vehicle to another vehicle. Furthermore, as vehicles move from the given area to another area through which a road network passes, a respective road network device for the other area may track the vehicles operating in the other area so that vehicles operating in the other area may be notified of the vehicles that can communicate electronic horizons.

An intersecting electronic horizon may include and/or be used to determine a multi-vehicle probability value that indicates a probability of whether two or more vehicles will arrive at a common position of a given road network simultaneously. If the multi-vehicle probability value exceeds a threshold probability value, one or more responsive measures can be taken to reduce the probability that those vehicles will arrive at the common position of a given road network simultaneously. Carrying out the responsive measures can have various benefits, such as collision avoidance and the efficient addition of vehicles to a vehicle platoon.

II. Example Architecture

FIG. 1 illustrates a simplified road network 100 for describing example embodiments in this detailed description. Road network 100 represents a network of roads, in any country or countries, upon which vehicles can travel. FIG. 1 illustrates two of those vehicles as vehicles 90 and 95, respectively. FIG. 1 also illustrates one road network device (RND) 80 that can be strategically placed, for example, in, on, or near a road network, or in orbit as a satellite. Vehicles that travel on a road network, such as vehicles 90 and 95, and a plurality of RNDs, including RND 80, can each include a computer-readable data storage device that contains digital map data and/or a map database that defines a road network, such as road network 100. For purposes of this description, the term digital map data hereinafter refers to digital map data and/or a map database.

The digital map data (e.g., digital map data 220, shown in FIG. 2) can include information about a road network, road geometry, road conditions, and other information. As an example, the digital map data can include data that defines road network 100, at least in part, as a plurality of nodes and road segments. FIG. 1 illustrates road segments 20, 21, 22, 23, 24, 25, 26, 27 and 28 and nodes 40, 41, 42, 43, 44, 45, 46, 47, 48 and 49. Additional details regarding the digital map data are described in U.S. Pat. Nos. 6,405,128 and 6,735,515.

The vehicles that operate and/or that are operable on road network 100 may be arranged to communicate with one another and/or with a plurality of RNDs, such as RND 80. Since the vehicles that operate on road network 100 may be in motion, the inter-vehicle communications, as well as the vehicle-to-RND and the RND-to-vehicle communications, may include wireless communications, such as radio frequency (RF) communications that occur via an air interface. In this regard, RND 80 may operate as a wireless access point so as to allow a vehicle to access vehicle data from one or more other vehicles and/or to provide vehicle data to one or more other vehicles.

FIG. 1 illustrates vehicle-to-RND communications 12 and 14, RND-to-vehicle communications 11 and 13, and inter-vehicle communications 15 and 16. Some or all of the vehicle-to-RND communications 12 and 14, the RND-to-vehicle communications 11 and 13, and the inter-vehicle communications 15 and 16 may occur directly between the vehicle and the RND or between the vehicles. Alternatively, some or all of the vehicle-to-RND communications 12 and 14, the RND-to-vehicle communications 11 and 13, and the inter-vehicle communications 15 and 16 may occur via one or more intermediary devices of a radio access network, such as a base transceiver station or a wireless access point.

RND 80 may be arranged in various configurations. As an example, RND 80 may include a road-side unit (RSU) that is positioned at a location near a road network (e.g., near a street). A location near a road network may, for example, include a location within five meters of the road network. Alternatively, the RSU may be positioned on the road network itself. Being positioned on the road network may include being positioned on a light post, a traffic light, or a traffic guard rail, or being positioned within a paved road of the road network. In accordance with this alternative configuration, the RSU may be referred to as an infrastructure device.

As another example, RND 80 may include a device that that is not positioned near the road network. In that regard, RND 80 may be positioned on a satellite orbiting Earth, or at a location on Earth but not near the road network (e.g., a location greater than five meters from the road network).

RND 80 may include a device that is operable to control traffic signals and display devices that are operable to visually present alerts to users of road network 100. As an example, RND 80 may control when a traffic signal for one or more directions of traffic changes to a signal that indicates vehicles heading in certain directions should stop at an intersection of two or more roads and simultaneously control when another traffic signal for vehicles heading in other directions should changes to a signal that indicates those latter vehicles may proceed through the intersection of two or more roads. As another example, RND 80 may control display devices positioned along road network 100 so as to present various visual alerts to users of road network 100, such as alerts that indicate traffic is congested ahead and/or an estimated time to travel to a given position on road network 100. Additional details regarding RND 80 are described with reference to FIG. 5.

Figure 2:
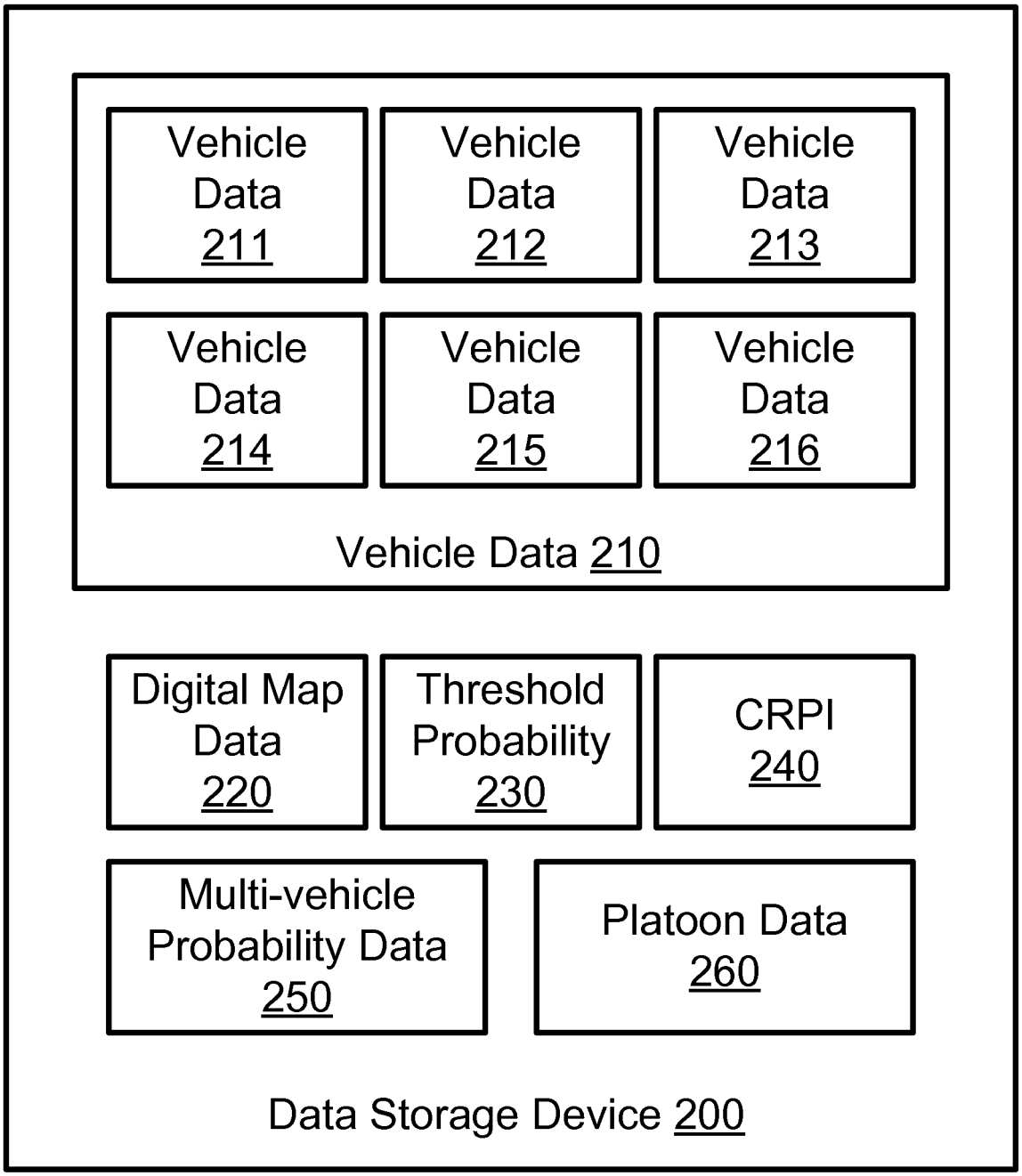
FIG. 2 is a block diagram of an example data storage device.

Next, FIG. 2 illustrates an example data storage device 200. Data storage device 200 may include a computer-readable storage medium readable by a processor. The computer-readable storage medium may include volatile and/or non-volatile storage components, such as optical, magnetic, organic, or other memory or disc storage, which can be integrated in whole or in part with the processor. As an example, data storage device 200 may be located at and/or within a vehicle, such as vehicle 90 or 95. As another example, data storage device 200 may be located at and/or within an RND, such as RND 80.

Data storage device 200 contains a variety of computer-readable data including vehicle data 210, digital map data 220 (described above), threshold probability data 230, computer-readable program instructions 240, multi-vehicle probability data 250, and platoon data 260. Details regarding platoon data 260 are described with respect to FIG. 3.

Vehicle data 210 may include vehicle data (e.g., electronic horizons) for a plurality of vehicles. In that regard, vehicle data may include any data within an electronic horizon. As illustrated in FIG. 2, vehicle data 210 includes vehicle data 211, 212, 213, 214, 215, and 216. Each of those vehicle data may be associated with a respective vehicle. By way of example, and for purposes of this description, vehicle data 211 is associated with vehicle 90, vehicle data 212 is associated with vehicle 95, vehicle data 213 is associated with a vehicle 91 (shown in FIG. 3) and vehicle data 214 is associated with a vehicle 92 (shown in FIG. 3). Vehicle data 215 and 216 may be associated with vehicles not shown in the figures.

Table 1 includes an example of vehicle data 211. The vehicle data may include data that identifies when the vehicle data was generated. By way of example, vehicle data 211 was generated at 9 o'clock in the morning on Jan. 1, 2011. Table 1 includes vehicle data for a single road segment (i.e., road segment 28) of road network 100. In that regard, the vehicle data shown in Table 1 includes only a portion of an electronic horizon that can be determined for vehicle 90. A person having ordinary skill in the art will understand that the vehicle data (i.e., the electronic horizon) for a given vehicle can include vehicle data for multiple segments of road network 100. That same person will also understand that vehicle data can be generated repeatedly as time passes (i.e., at different times) and as the vehicle travels on the road network.

TABLE 1

Example vehicle data (211)
Vehicle (90) - Road Segment (28) - Start Point: Node (44), End Point: Node (49)
Data Generation: Date: 1 Jan. 2011
Time: 09:00.00.00 (hours:minutes:seconds:hundredths of seconds)
Probability of Vehicle (90) traveling on Road Segment (28): 0.6

| Speed candidate | Vehicle Speed Probability | Time Parameter for Delta Distance 150 m Location: node (44) | Time Parameter for Delta Distance 200 m Location: node (49) | Probability of traveling on link at speed candidate |
|---|---|---|---|---|
| 8 m/s | 0.1 | 18.75 seconds | 25.00 seconds | 0.06 |
| 10 m/s | 0.2 | 15.00 seconds | 20.00 seconds | 0.12 |
| 12 m/s | 0.4 | 12.50 seconds | 16.67 seconds | 0.24 |
| 14 m/s | 0.2 | 10.71 seconds | 14.29 seconds | 0.12 |
| 16 m/s | 0.1 | 9.38 seconds | 12.50 seconds | 0.06 |

Vehicle data 211 includes a probability value that indicates the probability of vehicle 90 traveling on road segment 28 is 0.6 (i.e., 60%). The probability value of vehicle 90 traveling on each road segment of a road network may, for example, be determined by a data engine and/or a data horizon program (e.g., the data engine and/or data horizon program referred to in U.S. Pat. Nos. 6,405,128 and 6,735,515). Those probability values may be based on the potential paths vehicle 90 may travel, including the most-likely path of vehicle 90.

Vehicle data 211 includes multiple speed candidates representative of average speeds that vehicle 90 may travel if it travels on road segment 28, and multiple vehicle speed probability values that indicate the probability that vehicle 90 will travel at those speeds. The speed candidates may, for example, be based on various factors, such as a speed limit for traveling on the road segment corresponding to the speed candidate, historical speeds traveled by vehicle 90 (e.g., historical speeds traveled on road segments leading towards road segment 28, on road segment 28, and/or road segments leading away from road segment 28), traffic pattern information for road segment 28 (e.g., congested, not congested), conditions of road segment 28 (e.g., dry, wet, or icy), and a driving style associated with a driver of vehicle 90 (e.g., rarely exceeds speed limit or usually exceeds speed limits by one of a plurality of threshold speeds). A person having ordinary skill in the art will understand that vehicle data could include a different set of speed candidates and those different speed candidates could be in units other than meters per second.

Vehicle data 211 includes time parameters for two delta distances (i.e., 150 meters and 200 meters) from a current position of vehicle 90. A delta distance represents a distance a vehicle would have to travel to reach a given point within road network 100 from the vehicle's current position. For purposes of this description, the delta distances 150 m and 200 m are associated with node 44 and node 49, respectively. A person having ordinary skill in the art will understand that the delta distances listed in Table 1 are merely examples and other delta distances may be used. Moreover, the vehicle data may include delta distances for points within a road segment other than a start point or end point of a road segment.

The time parameters of vehicle data 211 represent an expected time value that vehicle 90 will arrive at the point associated with the delta distance. For example, if vehicle 90 travels at an average speed of 12 m/s, vehicle 90 will arrive at node 44 in 12.50 seconds (i.e., 150 m divided by 12 m/s).

In that regard, vehicle 90 would arrive at node 44 at the time 09:00.12.50 (i.e., 09:00.00.00 plus 12.50 seconds).

Vehicle data 211 also includes probability values that indicate a probability that vehicle 90 will travel on road segment 28 at a given speed candidate. For example, vehicle data 211 includes a probability value that represents the probability of vehicle 90 traveling on road segment 28 at an average speed of 12 m/s is 0.24 (i.e., the probability of vehicle 90 traveling on road segment 28 (i.e., 0.6) times the probability of vehicle 90 traveling at an average speed of 12 m/s on road segment 28 (i.e., 0.4)).

One or more time parameters associated with a given road segment may be identified as a respective most-probable time (MPT). In Table 1, the time parameters in the row for speed candidate 12 m/s may be identified as MPTs for road segment 28 and in particular, nodes 44 and 49, respectively, because vehicle data 211 shows that vehicle 90 will most likely travel on road segment 28 at an average speed 12 m/s. Identification of MPTs for the various road segments in an electronic horizon may be used to reduce the amount of data that gets transmitted to an RND and/or to one or more other vehicles if the vehicle only transmits vehicle data associated with the MPT (e.g., the data in one row of Table 1). Alternatively, vehicles may transmit vehicle data in addition to the vehicle data associated with the MPT.

Similarly, other vehicles operating on road network 100 with vehicle 90 may reduce the amount of data they transmit to vehicle 90 and/or to an RND by identifying MPTs for those vehicles. In that way, the data storage and processing burden on vehicle 90 and/or the RND may be reduced because vehicle 90 and/or the RND are receiving less vehicle data. Should vehicle 90 and/or the RND determine that it needs more data from a vehicle traveling on road network 100, vehicle 90 and/or the RND can request that the vehicle transmit additional vehicle data (e.g., vehicle data in addition to that which is associated with an MPT).

Next, Table 2 includes an example of vehicle data 212. Vehicle data 212 includes data that indicates it was generated at the same time vehicle data 211 was generated. However, vehicle data 211 and 212 are not so limited, as vehicle data 211 and 212 may be generated at different times. Table 2 includes vehicle data for a single road segment (i.e., road segment 28) of road network 100. In that regard, the vehicle data shown in Table 2 includes only a portion of an electronic horizon that can be determined for vehicle 95.

TABLE 2

Example vehicle data (212)
Vehicle (95) - Road Segment (28) - Start Point: Node (44), End Point: Node (49)
Data Generation: Date: 1 Jan. 2011
Time: 09:00.00.00 (hours:minutes:seconds:hundredths of seconds)
Probability of Vehicle (95) traveling on Road Segment (28): 0.8

| Speed Candidate | Vehicle Speed Probability | Time Parameter for Delta Distance 100 m Location: node (44) | Time Parameter for Delta Distance 150 m Location: node (49) | Probability of traveling on link at speed candidate |
|---|---|---|---|---|
| 4 m/s | 0.1 | 25.00 seconds | 37.50 seconds | 0.08 |
| 6 m/s | 0.2 | 16.67 seconds | 25.00 seconds | 0.16 |
| 8 m/s | 0.4 | 12.50 seconds | 18.75 seconds | 0.32 |
| 10 m/s | 0.2 | 10.00 seconds | 15.00 seconds | 0.16 |
| 12 m/s | 0.1 | 8.33 seconds | 12.50 seconds | 0.08 |

Vehicle data 212 includes a probability value that indicates the probability of vehicle 95 traveling on road segment 28 is 0.8 (i.e., 80%). Similar to the probability value of 0.6 in Table 1, the probability value of vehicle 95 traveling on each road segment of a road network may be determined by a data engine and/or a data horizon program. Vehicle data 212 includes multiple speed candidates representative of average speeds that vehicle 95 may travel if it travels on road segment 28, and multiple vehicle speed probability values representative of the probability that vehicle 95 will travel at those speeds.

Vehicle data 212 includes time parameters for two delta distances (i.e. 100 meters and 150 meters) from a current position of vehicle 95. For purposes of this description, the delta distances 100 m and 150 m are associated with node 44 and node 49, respectively. A person having ordinary skill in the art will understand that the delta distances listed in Table 2 are merely examples and other delta distances may be used. Moreover, vehicle data 212 may include delta distances for points within a road segment other than a start point or end point of a road segment.

The time parameters of vehicle data 212 represent an expected time value that vehicle 95 will arrive at the point associated with the delta distance. For example, if vehicle 95 travels at an average speed of 4 m/s, vehicle 90 will arrive at node 44 in 25.00 seconds (i.e., 100 m divided by 4 m/s). In that regard, vehicle 90 would arrive at node 44 at the time 09:00.25.00 (i.e., 09:00.00.00 plus 25.00 seconds).

Vehicle data 212 also includes probability values that indicate a probability that vehicle 95 will travel on road segment 28 at a given speed candidate. For example, vehicle data 212 includes a probability value that indicates the probability of vehicle 95 traveling on road segment 28 at an average speed of 8 m/s is 0.32 (i.e., the probability of vehicle 95 traveling on road segment 28 (i.e., 0.8) times the probability of vehicle 95 traveling at an average speed of 8 m/s on road segment 28 (i.e., 0.4)).

The number of vehicles represented by vehicle data within vehicle data 210 may vary from time to time. For example, the number of vehicles represented by vehicle data within vehicle data 210 may vary as the number of vehicles within an area around the vehicle comprising data storage device 200 changes or the number of vehicles within an area around RND 80 comprising data storage device 200 changes. For example, as the number of vehicles around the vehicle or RND 80 increases, the number of vehicles represented by vehicle data within vehicle data 210 may increase as more vehicles provide their vehicle data to the vehicle or RND 80. As another example, as the number of vehicles around the vehicle or RND 80 decreases, the number of vehicles represented by vehicle data within vehicle data 210 may decrease as fewer vehicles provide their vehicle data to the vehicle or RND 80.

Computer-readable program instructions (CRPI) 240 include various program instructions executable by a processor. In general, CRPI 240 may include program instructions to carry out the functions described in this description, and CRPI 240 may include program instructions arranged as a data horizon program and a data engine that is operable to determine and obtain from the map database the relevant data about road segments lying ahead of or behind a vehicle. More particular examples of CRPI 240 are described below.

For example, CRPI 240 may include program instructions that are executable to determine speed candidates and vehicle speed probabilities associated with those speed candidates. Those program instructions may use a variety of information to make the determinations. For instance, the information used to determine speed candidates and vehicle speed probabilities may include digital map data, such as a respective speed limit for driving on each road segment for which the speed candidate and vehicle speed probability are being determined, and data associated with the factors upon which speed candidates may be based.

As another example, CRPI 240 may include program instructions that are executable to obtain at least a portion of vehicle data from multiple vehicles and to use the obtained data to determine multi-vehicle probability values. For instance, CRPI 240 may include program instructions executable by a processor to generate multi-vehicle probability values. Each multi-vehicle probability value may indicate a probability that two or more vehicles will arrive at the same place at the same time. Generating the multi-vehicle probability values may include the processor comparing vehicle data 211 and 212. While comparing vehicle data 211 and 212, the processor can determine it is possible that vehicles 90 and 95 will simultaneously arrive at node 44 at the time 9:00:12.50 and it is possible that vehicles 90 and 95 will simultaneously arrive at node 49 at the time 9:00.12.50 or 9:00:25.00.

The processor can determine a first multi-vehicle probability value by multiplying the probability value that vehicle 90 will travel on road segment 28 at an average speed of 12 m/s so as to arrive at node 44 at the time 9:00:12.50 by the probability value that vehicle 95 will travel on road segment 28 at an average speed of 8 m/s so as to arrive at node 44 at the time 9:00:12.50 (i.e., 0.24 times 0.32). In that regard, the first multi-vehicle probability value of 0.0768 represents the probability that vehicles 90 and 95 will simultaneously arrive at node 44.

The processor can determine a second multi-vehicle probability value by (i) multiplying the probability value that vehicle 90 will travel on road segment 28 at an average speed of 8 m/s so as to arrive at node 49 at the time 9:00:25.00 by the probability value that vehicle 95 will travel on road segment 28 at an average speed of 6 m/s so as to arrive at node 49 at the time 9:00:25.00 (i.e., 0.06 times 0.16), (ii) multiplying the probability value that vehicle 90 will travel on road segment 28 at an average speed of 16 m/s so as to arrive at node 49 at the time 9:00:12.50 by the probability value that vehicle 95 will travel on road segment 28 at an average speed of 12 m/s so as to arrive at node 49 at the time 9:00:12.50 (i.e., 0.06 times 0.08), and (iii) adding the sums of those two products (i.e., (0.06 times 0.16) plus (0.06 times 0.08)). In that regard, the second multi-vehicle probability value of 0.0144 represents the probability that vehicles 90 and 95 will simultaneously arrive at node 49.

As another example, CRPI 240 may include program instructions executable by a processor to compare a multi-vehicle probability value to a threshold probability value contained in threshold probability data 230. Threshold probability data 230 includes at least one data value for comparing to a multi-vehicle probability value of multi-vehicle probability data 250. When threshold probability data 230 includes multiple values, those various values may be selected for comparing to a multi-vehicle probability value based on various factors, such as the condition of roads due to an amount of traffic, weather conditions, and time of day. For instance, the selected threshold data value may be relatively higher when the amount of traffic is relatively low (e.g., not congested), when the road conditions are good (e.g., not icy or snowy), and/or during certain daylight hours. Alternatively, the selected threshold value may be relatively lower when the amount of traffic is relatively high (e.g., congested), when the road conditions are poor (e.g., icy or snowy), and/or during night time hours.

Figure 3:
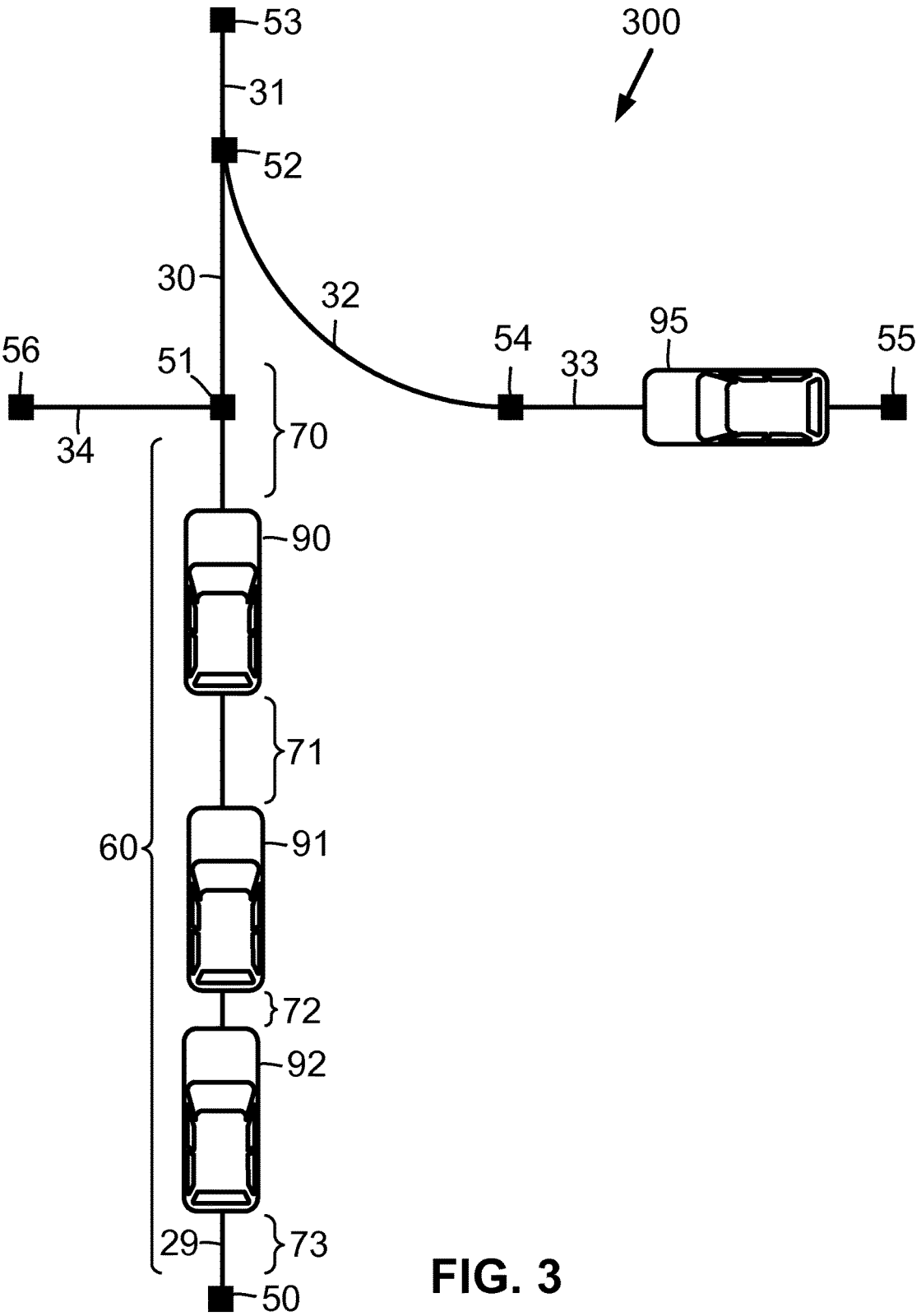
FIG. 3 illustrates another example road network.

Next, FIG. 3 illustrates another simplified road network 300. Road network 300 may be part of road network 100 or separate from road network 100. Similar to road network 100, road network 300 may be defined by digital map data. In that regard, the digital map data may define a plurality of road segments and a plurality of nodes. Those road segments and nodes may include, as illustrated in FIG. 3, road segments 29, 30, 31, 32, 33, and 34 and nodes 50, 51, 52, 53, 54, 55, and 56.

A vehicle platoon includes a plurality of vehicles whose actions on a road network are coordinated by communications. Those communications may include RF communications that are carried out using an air interface, as described below. FIG. 3 depicts a vehicle platoon 60 traveling on road network 300. Platoon 60 includes vehicles 90, 91, and 92. Vehicles within platoon 60 can leave the platoon. For example, vehicle 92 can leave platoon 60 by turning onto road segment 34 at node 51, whereas the other vehicles of platoon 60 continue traveling onto segment 30. Other vehicles can join platoon 60. For example, vehicle 95 can join platoon 60 by merging into a gap within platoon 60 when that gap occurs at node 52.

The communications carried out to coordinate vehicular action in the platoon can include data storable as platoon data 260. As an example, platoon data 260 may include data about each vehicle in platoon 60, as well as data about vehicles that may join the platoon and/or vehicles that were previously in the platoon. The data about each vehicle may identify a vehicle type (e.g., a 2010 model year Chevrolet Camaro, a Freightliner semi-tractor with 53 foot trailer, and a 2010 model year Range Rover Sport), and the dimensions of those vehicle types (e.g., 4.84 m, 19.80 m, and 4.78 m, respectively). As another example, platoon data 260 may include gap data that indicates the size of a gap in front of or behind a vehicle, and a location of the gap or a location of a vehicle associated with the gap. FIG. 3 illustrates a lead gap 70, intermediary gaps 71 and 72, and a trailing gap 73.

Table 3 includes example platoon data 260. Table 3 includes data regarding vehicle 95 because vehicle 95 is expected to join platoon 60. The "current position" in the Platoon Member column indicates an order of the vehicles. A vehicle at position (1) is the lead vehicle of a platoon, a vehicle at (final) is the vehicle at the rear of the platoon, and a vehicle at position (none) is not currently in the platoon. The "entry point" in the Joining Platoon column indicates a position (e.g., location) of road network 300 where a vehicle may join the platoon. The "exit point" in the Leaving Platoon column indicates a position of road network 300 where a vehicle may exit the platoon.

TABLE 3

| Example platoon data (260) | | | | | | |
|---|---|---|---|---|---|---|
| Vehicle | Platoon Member (Current Position) | Joining Platoon (Entry Point) | Leaving Platoon (Exit Point) | Vehicle length | Forward Gap (Ref. No) | Rearward Gap |
| 90 | Yes (1) | No | No | 5 m | 25 m (70) | 20 m (71) |
| 91 | Yes (2) | No | No | 5 m | 20 m (71) | 10 m (72) |
| 92 | Yes (Final) | No | Yes (Node 51) | 5 m | 10 m (72) | 15 m (73) |
| 95 | No (None) | Yes (Node 52) | No | 5 m | N.A. | N.A. |

The forward gaps and rearward gaps listed in Table 3 can be identified in various ways. For example, the forward gaps and rearward gaps can be determined via the use of vehicle sensors, such as sonar and radar sensors that are operable to provide signals to a processor for detecting a vehicle or another object in front of or behind a vehicle including the sensors. As another example, the forward gaps and rearward gaps can be determined via the use of location information that identifies the location of two vehicles in the platoon and vehicle dimension data of those two vehicles. Other examples of determining the forward gaps and rearward gaps are also possible. The forward and rearward gaps for vehicle 95 are listed as non-applicable (N.A.) because vehicle 95 has not yet joined platoon 60.

Next, Tables 4 and 5 include additional examples of vehicle data 211 and 212, respectively, and Tables 6 and 7 include examples of vehicle data 213 and 214, respectively. As an example, the vehicle data 211, 212, 213, and 214 and platoon data 260 may be contained in a data storage device (e.g., data storage device 200) within vehicle 95. In accordance with that example, an RF communications interface within vehicle 95 can receive vehicle data 211 from vehicle 90, vehicle data 213 from vehicle 91, and vehicle data 214 from vehicle 92. That RF communications interface can also receive portions of platoon data 260 from each of vehicles 90, 91, and 92. Additionally or alternatively, vehicle data 211, 212, 213, and 214, and platoon data 260 may be contained in a data storage device within a vehicle of platoon 60 and/or RND 80.

TABLE 4

Example vehicle data (211)
Vehicles (90) - Road Segment (31) - Start Point: Node (52), End Point: Node (53)
Data Generation: Date: 1 Jan. 2011
Time: 10:00.00.00 (hours:minutes:seconds:hundredths of seconds)
Probability of Vehicle (90) traveling on Road Segment (31): 0.9

| Speed Candidate | Vehicle Speed Prob. | Time Parameter for Delta Distance 200 m Location: node (52) Vehicle (90) | Time Parameter for Delta Distance 300 m Location: node (53) Vehicle (90) | Probability of traveling on link at speed candidate |
|---|---|---|---|---|
| 8 m/s | 0.1 | 25.00 seconds | 37.50 seconds | 0.09 |
| 10 m/s | 0.2 | 20.00 seconds | 30.00 seconds | 0.18 |
| 12 m/s | 0.5 | 16.67 seconds | 25.00 seconds | 0.45 |
| 14 m/s | 0.2 | 14.29 seconds | 21.43 seconds | 0.18 |

TABLE 5

Example vehicle data (213)
Vehicles (91) - Road Segment (31) - Start Point: Node (52), End Point: Node (53)
Data Generation: Date: 1 Jan. 2011
Time: 10:00.00.00 (hours:minutes:seconds:hundredths of seconds)
Probability of Vehicle (91) traveling on Road Segment (31): 0.9

| Speed Candidate | Vehicle Speed Prob. | Time Parameter for Delta Distance 220 m Location: node (52) Vehicle (91) | Time Parameter for Delta Distance 320 m Location: node (53) Vehicle (91) | Probability of traveling on link at speed candidate |
|---|---|---|---|---|
| 8 m/s | 0.1 | 27.50 seconds | 40.00 seconds | 0.09 |
| 10 m/s | 0.2 | 22.00 seconds | 32.00 seconds | 0.18 |
| 12 m/s | 0.5 | 18.33 seconds | 26.67 seconds | 0.45 |
| 14 m/s | 0.2 | 15.71 seconds | 22.86 seconds | 0.18 |

TABLE 6

Example vehicle data (214)
Vehicles (92) - Road Segment (31) - Start Point: Node (52), End Point: Node (53)
Data Generation: Date: 1 Jan. 2011
Time: 10:00.00.00 (hours:minutes:seconds:hundredths of seconds)
Probability of Vehicle (92) traveling on Road Segment (31): 0.1

| Speed Candidate | Vehicle Speed Prob. | Time Parameter for Delta Distance 230 m Location: node (52) Vehicle (92) | Time Parameter for Delta Distance 330 m Location: node (53) Vehicle (92) | Probability of traveling on link at speed candidate |
|---|---|---|---|---|
| 8 m/s | 0.1 | 28.75 seconds | 41.25 seconds | 0.01 |
| 10 m/s | 0.2 | 23.00 seconds | 33.00 seconds | 0.02 |
| 12 m/s | 0.5 | 19.17 seconds | 27.50 seconds | 0.05 |
| 14 m/s | 0.2 | 16.43 seconds | 23.57 seconds | 0.02 |

TABLE 7

Example vehicle data (212)
Vehicles (95) - Road Segment (31) - Start Point: Node (52), End Point: Node (53)
Data Generation: Date: 1 Jan. 2011
Time: 10:00.00.00 (hours:minutes:seconds:hundredths of seconds)
Probability of Vehicle (95) traveling on Road Segment (31): 0.9

| Speed Candidate | Vehicle Speed Prob. | Time Parameter for Delta Distance 300 m Location: node (52) Vehicle (95) | Time Parameter for Delta Distance 400 m Location: node (53) Vehicle (95) | Probability of traveling on link at speed candidate |
|---|---|---|---|---|
| 8 m/s | 0.2 | 37.50 seconds | 50.00 seconds | 0.18 |
| 10 m/s | 0.4 | 30.00 seconds | 40.00 seconds | 0.36 |

TABLE 7-continued

Example vehicle data (212)
Vehicles (95) - Road Segment (31) - Start Point: Node (52), End Point: Node (53)
Data Generation: Date: 1 Jan. 2011
Time: 10:00.00.00 (hours:minutes:seconds:hundredths of seconds)
Probability of Vehicle (95) traveling on Road Segment (31): 0.9

| Speed Candidate | Vehicle Speed Prob. | Time Parameter for Delta Distance 300 m Location: node (52) Vehicle (95) | Time Parameter for Delta Distance 400 m Location: node (53) Vehicle (95) | Probability of traveling on link at speed candidate |
|---|---|---|---|---|
| 12 m/s | 0.2 | 25.00 seconds | 33.33 seconds | 0.18 |
| 14 m/s | 0.1 | 21.43 seconds | 28.58 seconds | 0.09 |
| 16 m/s | 0.1 | 18.75 seconds | 25.00 seconds | 0.09 |

The vehicle data in Tables 4 through 7 pertain to a single road segment of road network 300. A person having ordinary skill in the art will understand that the vehicle data for one or more vehicles can include vehicle data for more than one road segment. For example, vehicle data 211, 213, and 214 can include vehicle data for road segments 29, 30, and 34, as well as for additional road segments beyond those shown in FIG. 3. As another example, vehicle data 212 can include vehicle data for road segments 32 and 33, as well as for additional road segments beyond those shown in FIG. 3.

For purposes of this description, the time parameters in Tables 1, 2, and 4 through 7 are taken to be the times when a front end of a vehicle reaches a given position (e.g., a node) in the road network. A person having ordinary skill in the art will understand that the time parameters in one or more of those tables could be taken to be the time when a position half way between the front and back of a vehicle reaches the given position, or when some other portion of the vehicle reaches the given position.

The vehicle data in Tables 4 through 7 may be combined to determine multi-vehicle probabilities in the same manner that the vehicle data in Tables 1 and 2 are combinable to form multi-vehicle probabilities.

The data in Tables 4 through 7 and platoon data 260 can be used to determine additional data regarding a vehicle expected to enter platoon 60. That additional data can be determined, for example, via a processor at a vehicle and/or a processor at an RND. Data within Tables 4 and 5 indicate that the probability of vehicles 90 and 91 traveling on road segment 31 at an average speed of 12 m/s is 45%. In such an occurrence, the front of vehicle 90 will reach node 52 in 16.67 seconds, the rear end of vehicle 90 will reach node 52 in 17.08 second (i.e., 205 meters divided by 12 m/s) and the front end of vehicle 91 will reach node 52 in 18.33 seconds. With vehicles 90 and 91 traveling at an average speed of 12 m/s, gap 71 will exist at node 52 during the time range of 17.08 seconds and 18.33 seconds after the vehicle data in Tables 4 and 5 were generated. Thus, one possibility for vehicle 95 to merge into platoon 60, as a vehicle at the second position, is for vehicle 95 to arrive at node 52 when gap 71 exists at node 52.

Referring to Table 7, vehicle 95 is 300 m away from node 52. In order for vehicle 95 to arrive at node 52 within the time range of 17.08 seconds and 18.33 seconds, a processor can execute program instructions to determine a range of average speeds that vehicle 95 can travel to arrive at node 52 within that time range. The range of average speeds for that time range is 16.37 m/s (i.e., 300 meters divided by 18.33 seconds) to 17.56 m/s (i.e., 300 meters divided by 17.07 seconds). Upon determining that range of average speeds, a responsive measure can be initiated. For example, a visual or audible alert can be presented at vehicle 95 so as to cause a driver of vehicle 95 or a control system within vehicle 95 to alter the speed of vehicle 95 to a speed within the determined range of speeds.

Alternatively, a processor may execute program instructions to determine that the probability of vehicle 95 entering platoon 60 while gap 71 exists at node 52 is too low. Such determination may be made by comparing a probability of vehicle 95 traveling on road segment 31 at an average speed of 16.37 to 17.56 m/s or at an average speed closest to that range of speeds to a threshold probability 230. Referring to Table 7, the probability of vehicle 95 traveling on road segment 31 at a rate of 16 m/s is 9%, whereas the probability of vehicle 95 traveling on road segment 31 at a rate of 10 m/s is 36%. By referring to the data in Table 7, the processor may determine that it is more probable that vehicle 95 could enter platoon 60 when gap 72 exists over node 51 or gap 73 exists of over node 51 if vehicle 92 does not exit platoon 60. The processor may cause an RF communications interface to transmit messages to other vehicles or RND 80 to provide notice that vehicle 95 should enter platoon 60 at a vehicle position after the second position.

Figure 4:
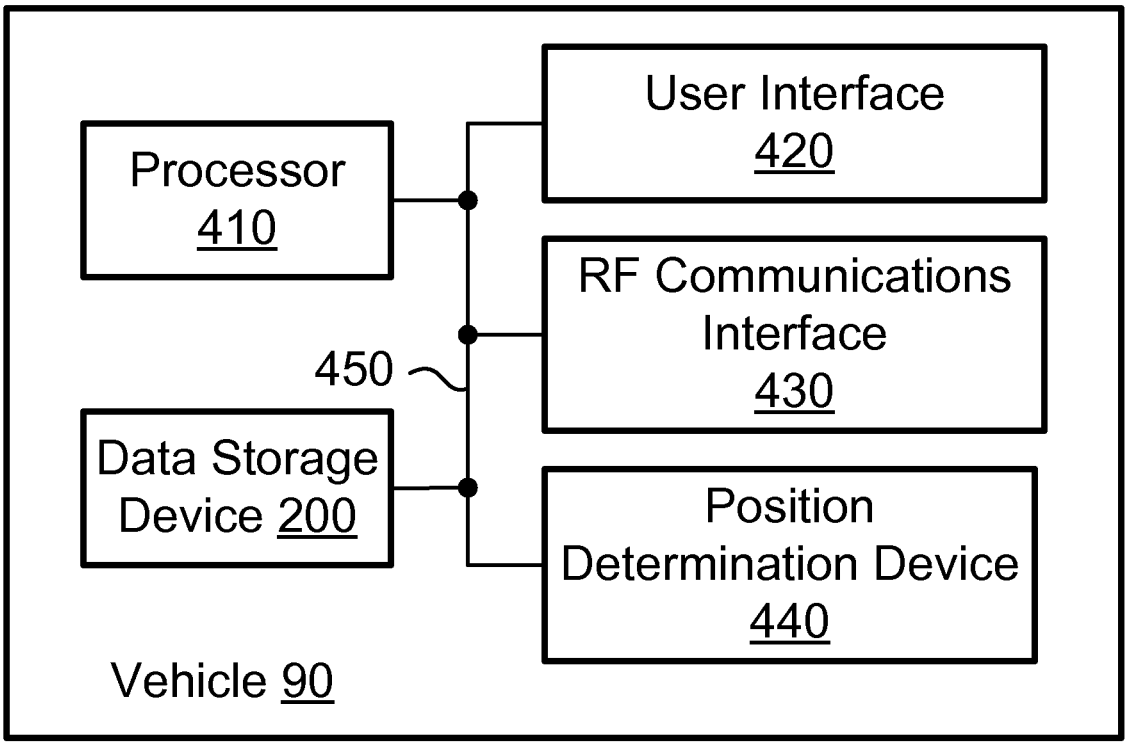
FIG. 4 is a block diagram of example components of an example vehicle.

Next, FIG. 4 is a block diagram of example components within vehicle 90. As illustrated in FIG. 4, vehicle 90 may include a processor 410, a user interface 420, a radio frequency (RF) communications interface 430, a position determination device 440, and data storage device 200, all of which may be linked together via a system bus, network, or other connection mechanism 450. A person having ordinary skill in the art will understand that other vehicles, such as vehicles 91, 92, and 95, may be arranged in a configuration similar to vehicle 90.

Processor 410 may include one or more general purpose processors (e.g., Intel microprocessors) and/or one or more special purpose processors (e.g., digital signal processors). Processor 410 may execute computer-readable program instructions contained in data storage device 200.

User interface 420 may include a device that is operable to present information to a user of vehicle 90. As an example, user interface 420 may include a display (e.g., a liquid crystal display and/or one or more other displays) to visually present alerts to a user of vehicle 90. As another example, user interface 420 may include one or more speakers to audibly present alerts to a user of vehicle 90. Processor 410 may execute program instructions that cause user interface 420 to present the alerts.

The alerts presented via user interface 420 may include alerts that are presented as responsive measures if processor 410 determines that a multi-vehicle probability value exceeds a threshold probability value. Additionally or alternatively, the alerts presented via user interface 420 may include alerts to provide notice regarding (i) a vehicle expected to merge into the path of vehicle 90, (ii) a vehicle entering a platoon comprising vehicle 90, (iii) a vehicle exiting a platoon comprising vehicle 90, (iv) a responsive measure to take such as changing a speed of vehicle 90 and/or a heading of vehicle 90, (v) instructions for merging vehicle 90 into a flow of other vehicles, or (vi) instructions for vehicle 90 to enter or exit a platoon. Other examples of alerts presentable via user interface 420 are also possible.

User interface 420 may also include a device that is operable to allow a user of vehicle 90 to input data for use by the components of vehicle 90. As an example, user interface 420 may include a switch (e.g., a push button or a key on a keypad) that is operable to (i) input a signal to terminate (e.g., turn off) an alert being presented by user interface 420, (ii) select a desired destination for vehicle 90, (iii) select a preferred path for traveling to the desired destination, and/or (iv) turn on or off an automatic vehicle speed control of the vehicle 90 (e.g., cruise control).

RF communications interface 430 may include any of a variety of RF transceivers that are operable to transmit and receive RF communications. Transmission of the RF communications may include transmitting vehicle data 211 to one or more other vehicles and/or to one or more RNDs, such as RND 80. Receiving the RF communications may include receiving vehicle data from one or more other vehicles, such as vehicle data 212 and 213, and/or receiving data from one or more RND, such as RND 80. RF communications interface 430 may operate according to any of a variety of air interface protocols and/or standards, such as the Interim Standard 95 (IS-95) for code division multiple access (CDMA) RF communications, an IEEE 802.11 standard for wireless local area networks, an IEEE 802.16 standard for broadband wireless access (e.g., a WiMAX standard), or some other air interface standard now known or later developed (e.g., a Car-2-Car Communication Standard being developed by the Car 2 Car Communication Consortium, Braunschweig, Germany) With regard to the IEEE 802.11 standard, as an example, the standard may include the IEEE 802.11p standard for Wireless Access for the Vehicular Environments (WAVE).

Position determination device 440 may include a device that is operable to determine a position (e.g., a geographic location) of the vehicle comprising position determination device 440 (e.g., vehicle 90). As an example, position determination device 440 may include a global positioning system (GPS) receiver and associated circuitry for receiving and processing RF signals from GPS satellites so as to determine a position of vehicle 90.

As indicated above, vehicle 90 may include data storage device 200, which contains CRPI 240. The CRPI in data storage 200 implemented in vehicle 90 are executable by processor 410. The CRPI executable by processor 410 may include program instructions for generating vehicle data 211 (i.e., the electronic horizon) for vehicle 90 and for causing RF communications interface 430 to transmit vehicle data 211 to one or more other vehicles, such as vehicle 95, or to one or more RNDs, such as RND 80.

Figure 5:
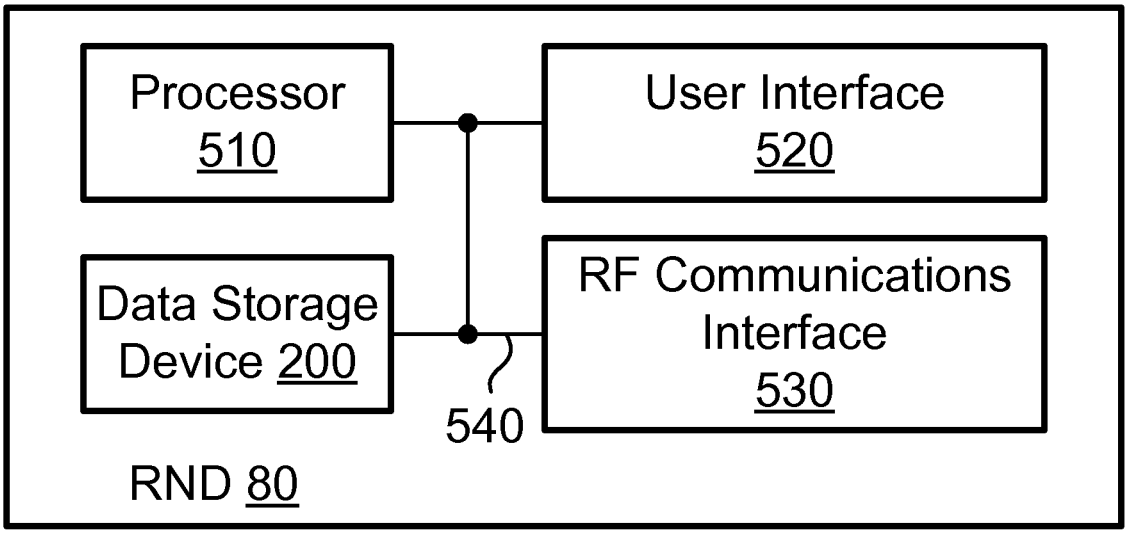
FIG. 5 is a block diagram of example components of an example road network device (RND)

Next, FIG. 5 is a block diagram of example components within RND 80. As illustrated in FIG. 5, RND 80 may include a processor 510, a user interface 520, an RF communications interface 530, and data storage device 200, all of which may be linked together via a system bus, network, or other connection mechanism 540. A person having ordinary skill in the art will understand that other RND may be arranged in a configuration similar to RND 80.

Processor 510 may include one or more general purpose processors (e.g., Intel microprocessors) and/or one or more special purpose processors (e.g., digital signal processors). Processor 510 may execute computer-readable program instructions contained in data storage device 200.

User interface 520 may include a device that is operable to present information to a user of RND 80. As an example, user interface 520 may include a display (e.g., a liquid crystal display and/or one or more other displays) to visually present a graphical user interface that allows a user to add, modify, and or delete data within data storage device 200. User interface 520 may also include a device that is operable to allow a user of RND 80 to input data for use by the components of RND 80. As an example, user interface 520 may include a switch (e.g., a push button or a key on a keypad) that is operable to input a signal to add, modify, and or delete data contained in data storage device 200.

RF communications interface 530 may include any of a variety of RF transceivers that are operable to transmit and receive RF communications. Transmission of the RF communications may include transmitting an alert to one or more vehicles, such as vehicle 90. Receiving the RF communications may include receiving vehicle data from multiple vehicles, such as vehicle data 212 from vehicle 90 and vehicle data 213 from vehicle 95. RF communications interface 530 may also transmit communications to and/or receive communications from another RND. RF communications interface 530 may operate according to any of a variety of air interface standards, such as the Interim Standard 95 (IS-95), an IEEE 802.11 air interface standard, an IEEE 802.16 air interface standard, or some other air interface standard now known or later developed.

As indicated above, RND 80 may include data storage device 200, which contains CRPI 240. The CRPI in data storage 200 implemented in RND 80 are executable by processor 510. The CRPI executed by processor 510 can cause processor 510 to determine, for one or more intersections having traffic signals (e.g., traffic lights comprising red, amber and green lights) to control a flow of traffic through the intersection, a probable arrival time of vehicles reaching a given area prior to each of the one or more intersections.

Upon determining those probable arrival times for a given intersection, processor 510 can determine whether the on/off state of the traffic signals at that intersection should be altered. For example, if processor 510 determines that, at a given time, one vehicle will probably be on road segment 28 within an area prior to the intersection at node 44 and six vehicles will probably be on road segment 22 within an area prior to the intersection at node 44, processor 510 may determine to alter the state of the traffic signals at that intersection so that the six vehicles will be allowed to pass through the intersection without stopping at the intersection. Processor 510 may base its determination to alter the state of the traffic signals based on the probabilities of vehicles being in the area prior to an intersection being greater than a threshold probability.

III. Example Operation

Figure 6:
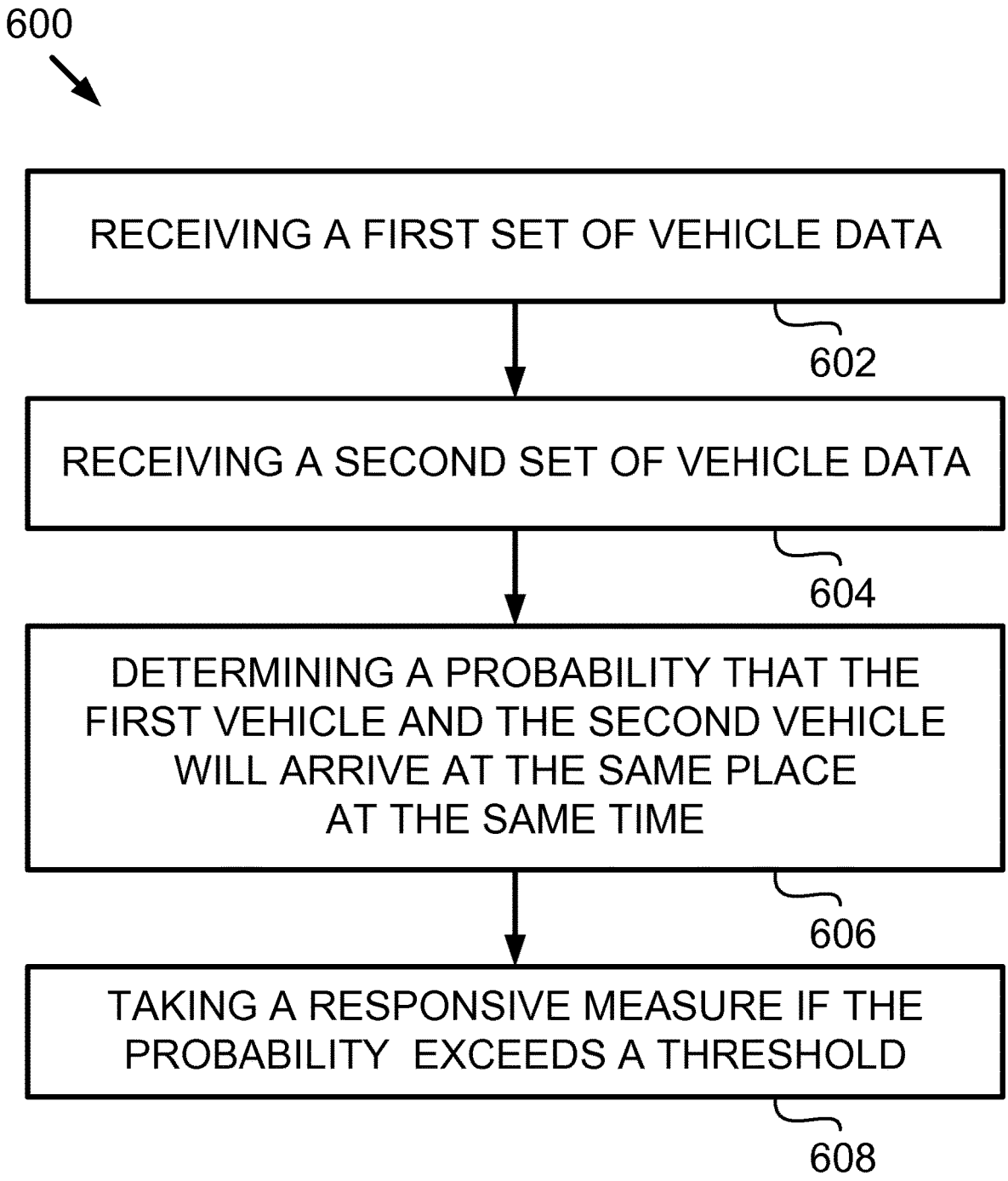
FIG. 6 is a flow chart depicting a set of functions that may be carried out in accordance with an example embodiment.

FIG. 6 is a flow chart depicting a set of functions 600 that may be carried out in accordance with an example embodiment. The set of functions 600 may be carried out at any of a variety of elements. As an example, the set of functions 600 may be carried out at a vehicle, such as vehicle 90, and/or some other vehicle. In accordance with that example, at least a portion of the set of functions 600 may be carried out by processor 410. As another example, the set of functions 600 may be carried out at an RND, such as RND 80. In accordance with that example, at least a portion of the set of functions 600 may be carried out by processor 510.

Block 602 includes receiving a first set of vehicle data. The first set of vehicle data includes data that is associated with both a first vehicle and a given road segment defined for a road network on which the first vehicle can travel. As an example, the first set of vehicle data may be generated at vehicle 90 and the first set of vehicle data may include vehicle data 211.

In accordance with an embodiment in which the set of functions 600 is carried out by vehicle 90, receiving the first set of vehicle data may include processor 410 receiving the first set of vehicle data from data storage device 200 or data storage device 200 receiving the first set of vehicle data from processor 410 after generation of the first set of vehicle data. In accordance with an embodiment in which the set of functions 600 is carried out by RND 80, receiving the first set of vehicle data may include RF communications interface 530 receiving the first set of vehicle data via vehicle-to-RND communications 12 from vehicle 90.

Next, block 604 includes receiving a second set of vehicle data. The second set of vehicle data includes data that is associated with a second vehicle and the given road segment defined for the road network. The second vehicle (e.g., vehicle 95) can travel on the same road segment that the first vehicle (e.g., vehicle 90) can travel. The second vehicle can generate the second set of vehicle data and then transmit the second set of vehicle data via an air interface.

In accordance with an embodiment in which the set of functions 600 is carried out by vehicle 90, receiving the second set of vehicle data may include RF communications interface 430 receiving the second set of vehicle data via the air interface. In accordance with an embodiment in which the set of functions 600 is carried out by RND 80, receiving the second set of vehicle data may include RF communications interface 530 receiving the second set of vehicle data via the air interface from vehicle 95.

Next, block 606 includes determining a probability that the first and second vehicles will arrive at the same place at the same time. A processor using at least a portion of the first set of vehicle data and at least a portion of the second set of vehicle data determines a first multi-vehicle probability value that indicates a probability that the first vehicle and the second vehicle will arrive at a common position of the given road segment simultaneously. The common position may be located at or between nodes of a road segment.

A processor, such as processor 410 or processor 510 may execute CRPI 240 to determine the first multi-vehicle probability value. Executing those program instructions may include obtaining the vehicle data used to determine the value from data storage device 200. Examples of determining a multi-vehicle probability value are described above with respect to Table 1 and Table 2.

In response to determining the first multi-vehicle probability value, the processor that determines the first multi-vehicle probability value may execute computer-readable program instructions to select a threshold probability value from data storage device 200 and then compare the first multi-vehicle probability value to the selected threshold probability value. If data storage device 200 contains a single threshold probability value, then selecting the threshold probability value includes selecting that threshold probability value. If data storage device 200 contains a plurality of threshold probability values, then selecting the threshold probability value includes selecting one of the threshold probability values. Such selection may be based on a variety of factors, such as road conditions, probable speeds of the first and second vehicles, time of day, or any of a variety of other factors.

The vehicle data for the first vehicle and the vehicle data for the second vehicle may each include vehicle data associated with a plurality of road segments of a road network. The plurality of road segments of those vehicle data may include road segments common to both vehicle data as well as road segments found in only one of those vehicle data. As the first vehicle and second vehicle move from one position in road network 100 to another position within road network 100, the vehicle data for each of those vehicles can change.

Since the vehicle data for the first vehicle and the vehicle data for the second vehicle can each include data for multiple road segments, a processor having access to that vehicle data may determine a plurality of multi-vehicle probability values. Two or more of those probability values may be associated with a common road segment of road network 100 (e.g., two multi-vehicle probability values associate with road segment 28) or with different road segments of road network 100 (e.g., a multi-vehicle probability value associated with road segment 28 and another multi-vehicle probability value associated with road segment 22).

Next, block 608 includes taking a responsive measure if the multi-vehicle probability value exceeds a threshold probability value. Taking the responsive measure may be carried out in various ways.

In accordance with an example embodiment in which vehicle 90 determines the first multi-vehicle probability value exceeds the threshold probability value, taking the responsive measure may be carried out, at least in part, by processor 410 executing program instructions to carry out the responsive measure. Executing those program instructions may cause RF communications interface 430 to transmit an alert to vehicle 95 so as to cause a driver or vehicle 95 to change a speed and/or direction of vehicle 95, or to transmit an alert to RND 80. Additionally or alternatively, executing the program instructions may cause user interface 420 to present a visual or audible alert.

In accordance with an example embodiment in which RND 80 determines the first multi-vehicle probability value exceeds the threshold probability value, taking the responsive measure may be carried out, at least in part, by processor 510 executing program instructions to carry out the responsive measure. Executing those program instructions may cause RND 80 to transmit an alert to the first vehicle and/or the second vehicle via an air interface. Additionally or alternatively, executing those program instructions may cause user interface 520 to visually or audibly present an alert to drivers of vehicles traveling on road network 100.

IV. Conclusion

Example embodiments have been described above. Those skilled in the art will understand that changes and modifications may be made to the described embodiments without departing from the true scope and spirit of the present invention, which is defined by the claims.

The invention claimed is:

1. An apparatus comprising:

a memory configured to store data indicative of paths from current positions of a plurality of vehicles including a first vehicle and a second vehicle;

a processor configured to calculate a multiple-vehicle probability based on the data indicative of paths from current positions of the plurality of vehicles, the multi-vehicle probability based on a first probability that the first vehicle travels at a first predetermined speed on a road segment and a second probability that the second vehicle travels at a second predetermined speed on the road segment, wherein the first probability is based on historical speed data associated with the road segment; and a user interface configured to provide an alert message in response to the multiple- vehicle probability value.

2. The apparatus of claim 1, wherein the alert message includes data that indicates a vehicle is expected to merge into the path.

3. The apparatus of claim 1, wherein the alert message includes data that indicates a vehicle is exiting a platoon.

4. The apparatus of claim 1, wherein the alert message includes data that indicates a vehicle is entering a platoon.

5. The apparatus of claim 1, wherein the alert message includes instructions to merge into a flow of other vehicles.

6. The apparatus of claim 1, wherein the user interface is configured to receive an input to terminate the alert message and an input to select a desired destination.

7. The apparatus of claim 1, further comprising:

a position determination device configured to determine a position of the apparatus.

8. The apparatus of claim 1, further comprising:

a communication interface configured to receive the data indicative of paths from current positions of the plurality of vehicles from a wireless access point.

9. The apparatus of claim 1, wherein the historical speed data includes speeds traveled on road segments leading to or away from the road segment.

10. A method comprising:

receiving data indicative of paths from current positions of a plurality of vehicles including a first vehicle and a second vehicle;

calculating a multiple-vehicle probability based on the data indicative of paths from current positions of the plurality of vehicles, the multi-vehicle probability based on a first probability that the first vehicle travels at a first predetermined speed on a road segment and a second probability that the second vehicle travels at a second predetermined speed on the road segment, wherein the first probability is based on historical speed data associated with the road segment;

performing a comparison of the multiple-vehicle probability to a threshold value; and generating an alert message in response to the comparison of the multiple-vehicle probability to the threshold value.

11. The method of claim 10, wherein the alert message includes data that indicates a vehicle is expected to merge into the path.

12. The method of claim 10, wherein the alert message includes data that indicates a vehicle is exiting or entering a platoon.

13. The method of claim 10, wherein the alert message includes instructions to merge into a flow of other vehicles.

14. The method of claim 10, further comprising:

receiving a first input to select a desired destination, wherein at least one of the paths for the plurality of vehicle corresponds to the desired destination.

15. The method of claim 10, wherein the data indicative of paths from current positions of the plurality of vehicles includes a set of paths for a first vehicle and a set of paths for a second vehicle.

16. A non-transitory computer readable medium including instructions that when executed by a processor perform:

identifying data indicative of paths from current positions of a plurality of vehicles including a first vehicle and a second vehicle;

calculating a multiple-vehicle probability based on the data indicative of paths from current positions of the plurality of vehicles, the multi-vehicle probability based on a first probability that the first vehicle travels at a first predetermined speed on a road segment and a second probability that the second vehicle travels at a second predetermined speed on the road segment, wherein the first probability is based on historical speed data associated with the road segment;

performing a comparison of the multiple-vehicle probability to a threshold value; and generating an alert message in response to the comparison of the multiple-vehicle probability to the threshold value.

17. The non-transitory computer readable medium of claim 16, wherein the alert message includes data that indicates a vehicle is expected to merge into the path.

18. The non-transitory computer readable medium of claim 16, wherein the alert message includes data that indicates a vehicle is exiting a platoon or entering a platoon.

19. The non-transitory computer readable medium of claim 16, wherein the alert message includes instructions to merge into a flow of other vehicles.

20. The non-transitory computer readable medium of claim 16, wherein the threshold value is set according to road conditions, traffic conditions, weather conditions, or a time of day.

* * * * *